United States Patent [19]

Aznavoorian

[11] Patent Number: 4,894,880

[45] Date of Patent: Jan. 23, 1990

[54] TOOTH BRUSH

[76] Inventor: Martin P. Aznavoorian, 2 Rebecca Str., Auldana, 5072; S. A., Australia

[21] Appl. No.: 305,718

[22] Filed: Feb. 3, 1989

[51] Int. Cl.[4] ..... A46B 9/04

[52] U.S. Cl. ..... 15/167.2; 128/62 A; D4/104; D4/105

[58] Field of Search ..... 15/167.1, 167.2; 128/62 A; D4/104–112

[56] References Cited

U.S. PATENT DOCUMENTS 4,570,282 2/1986 Kaufman et al. ..... 15/167.1

FOREIGN PATENT DOCUMENTS 825856 12/1937 France ..... 15/167.2

*Primary Examiner*—Harvey C. Hornsby
*Assistant Examiner*—K. O'Leary
*Attorney, Agent, or Firm*—Lee, Mann, Smith, McWilliams & Sweeney

[57] ABSTRACT

A tooth brush having a plurality of rows of bristles of varying stiffness and cut. Outer bristles are directed to the gum line, while inner bristles work directly on the tooth surface. The inner bristles are stiffer than the outer bristles to assure proper scrubbing of the tooth surface.

12 Claims, 1 Drawing Sheet

TOOTH BRUSH

BACKGROUND OF THE INVENTION

This invention relates to tooth brushes, and in particular to a tooth brush that not only cleans the teeth, but also removes food particles at the gum line and provides gum massage in order to eliminate gum diseases.

Gum diseases are the primary cause of tooth loss in adults. If gums recede, teeth eventually loosen and are lost. As a result, modern dental care has led to development of various types of brushes, cleaners, tooth pastes and mouth washes to help retard and control gum diseases. For many years, and well into the previous century, various tooth brushes have been devised in an effort to effect proper tooth scrubbing and removal of lodged food and other materials.

U.S. Pat. No. 569,870 discloses a tooth brush that may be used to scrub the front and back surfaces of teeth in the same operation. A similar result occurs with the tooth brush of U.S. Pat. Nos. 1,091,291; 1,353,780; 2,214,407 and 2,244,615. Variations on such structures are also shown in French Patent No. 825,856 (Mar. 16, 1938), German Patent No. 818,794 (Sept. 20, 1951) and British Patent No. 745 of Jan. 18, 1886.

Of the above patents, U.S. Pat. No. 2,244,615 discloses a tooth brush structure in which inner bristles are softer than outer bristles, apparently because the outer bristles are longer. No attention is given to shaping of the rows of bristles, with the intent being to simply form a channel for guiding a tooth brush along the teeth to effect scrubbing of all tooth surfaces at the same time.

SUMMARY OF THE INVENTION

The present invention is directed to a tooth brush that is effective in reducing tartar accumulation on tooth surfaces, and thus substantially eliminate the possibility of gum disease. The tooth brush, in a similar fashion to all modern tooth brushes, has a longitudinal body, one end of the body forming a handle and the other end of the body having a series of generally parallel longitudinal rows of bristles. The invention departs from the prior art by providing a pair of outer rows of bristles, each outer row being located at an opposite side of the rows of bristles of the tooth brush, and the bristles of the outer rows having a first stiffness. A second pair of inner rows of bristles is located in the tooth brush, with each inner row being located adjacent one of the outer rows, and the bristles of the inner rows having a second stiffness which is greater than the sfiffness of the outer rows. A central row of bristles is located between the inner rows, the bristles of the central row having a third stiffness which is not less than the stiffness of the inner rows of bristles. The bristles of the central row terminate at and form a generally flat brushing plane, while at least a first portion of the bristles of the inner and outer rows on one side of the central row terminate at a first inclined brushing plane and at least a first portion of the bristles of the inner and outer rows on the other side of the central row terminate at a second inclined brushing plane, the inclined brushing planes being oriented at an angle of from about 80° to 100° to one another.

In accordance with the preferred embodiment of the invention, the angle between the two brushing planes is 90°. Also, the brushing planes are symmetrical with respect to the central row so that brushing characteristics on one side of the central row do not differ from those on the other side.

In accordance with the disclosed embodiment of the invention a second portion of the bristles of the outer rows terminates at a flat surface generally parallel to and spaced from the flat brushing plane of the central row. The flat surface is oriented at an acute angle of from about 40° to 50° to the inclined brushing planes, with the preferred angle being 45°. Also, a second portion of the bristles of the inner rows also terminates at a similar flat surface generally parallel to and spaced from the flat brushing plane, with that flat surface as well being oriented at an acute angle of from about 40° to 50° to the inclined brushing planes, with the preferred angle being 45°. Thus, each of the rows (other than the central row) terminates at tips which have an inclined portio and a flattened portion which is parallel to the flat brushing plane of the central row of bristles.

BRIEF DESCRIPTION OF THE DRAWING

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
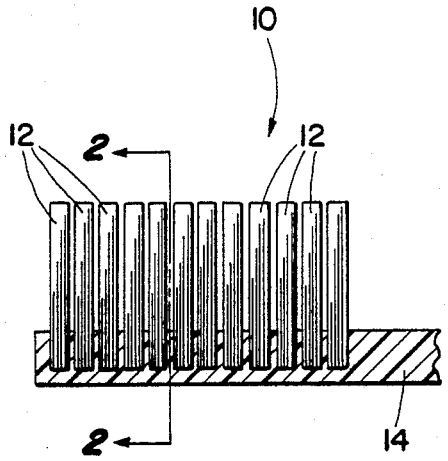
FIG. 1 is an enlarged side elevational view of a tooth brush according to the invention, partially in cross section to illustrate embedding of bristles into the body of the tooth brush, with the conventional handle of the tooth brush not being illustrated.

A tooth brush according to the invention is shown generally at 10 in FIG. 1. The the tooth brush 10 comprises two basic elements, a plurality of rows of bristles 12, and a longitudinal body 14 into which the rows of bristles 12 are engaged. The opposite end of the body 14 (not illustrated) may include a conventional handle. The means by which the bristles are engaged in the body may also be conventional. The material of the body 14 also may be conventional, such as plastic, and forms no part of the invention.

Figure 2:
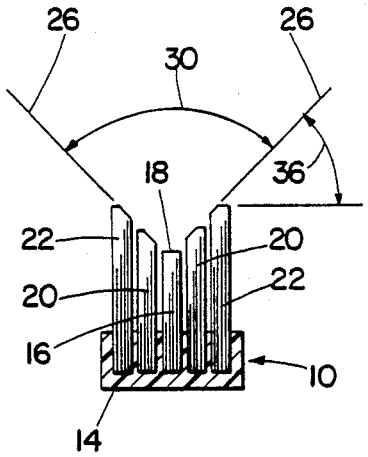
FIG. 2 is a cross-sectional view taken along lines 2—2 of FIG. 1.
Figure 3:
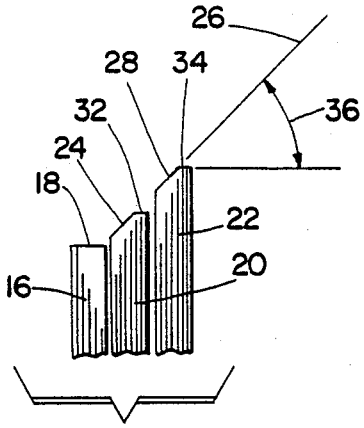
FIG. 3 is a further enlarged cross-sectional view of a portion of the bristles of the tooth brush shown in FIG. 2, illustrating, from left to right, the central row, inner row and outer row of bristles.

The tooth brush 10 includes a central row of bristles 16 which, as best illustrated in FIGS. 2 and 3, terminates at and forms a generally flat brushing plane 18. On each side of the central row 16 is located an inner row of bristles 20. A pair of outer rows of bristles 22 sandwich the inner rows 20 and central row 16 between them.

The bristles of all of the rows 16, 20 and 22 may be of conventional material, such as nylon. The bristles of the outer rows 22 have a first stiffness, while the bristles of the inner rows 22 have a second stiffness that is greater than the first stiffness, and the bristles of the central row 16 have a third stiffness which is not less than the second stiffness. Thus, the central row 16 and inner rows 20 have bristles which are stiffer than the bristles of the outer row 22. As will be seen below, the bristles of the outer row 22 are those bristles that engage the gum.

As shown in FIGS. 2 and 3, a first portion 24 of the bristles of each of the inner rows 20 terminates at an inclined brushing plane 26. Similarly, a first portion 28 of the bristles of the outer row 22 terminates at the inclined brushing plane 26. As shown in FIG. 2, the brushing planes 26 are oriented at an angle 30 with respect to one another, with the angle at 30 being of from about 80° to 100°, with the preferred angle being 90°, the angle actually illustrated in FIG. 2. Preferably, the planes 26 are symmetrical with respect to the central row 16 so that brushing characteristics of the bristles on opposite sides of the central row 16 are identical.

A second portion 32 of the bristles of the inner rows 24 terminates at a flat surface generally parallel to, but spaced from, the flat brushing plane 18. Similarly, a second portion 34 of the bristles of the outer rows 22 terminates at a flat surface which is generally parallel to, but also spaced from, the flat brushing plane 18. As illustrated, the flat surface of the second portion 32 is located between the brushing plane 18 and the flat surface of the second portion 34. Each of the flat surfaces is oriented at an acute angle at 36 of from about 40° to 50° to the inclined brushing planes 26, with the preferred angle being 45°, which is the angle actually illustrated in the drawings. Thus, each of the rows of bristles, with the exception of the central row 16, has an inclined portion forming the inclined brushing plane 26, and a flat surface. The flat surfaces of the rows 20 and 22 are parallel to the flat brushing plane 18.

Figure 4:
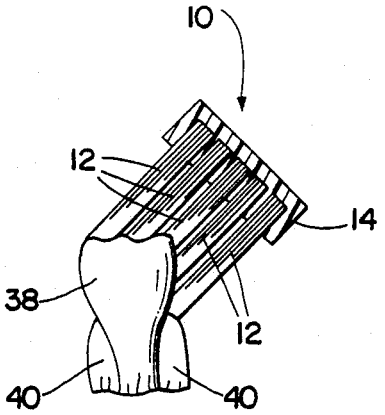
FIG. 4 is a cross-sectional view, similar to FIG. 2, showing the toothbrush according to the invention when engaged on a tooth.

Proper use of the tooth brush 10 is shown in FIG. 4. As the tooth brush 10 traverses a tooth 38, the central row 16 and inner rows of bristles 20 scrub the surface of the tooth 38, while one of the softer outer rows 22 is directed to the gum line (between the tooth 38 and the gum 40) to remove any debris that has become lodged between the tooth 38 and gum 40. In addition, the gums 40 are massaged, and the brushing action helps eliminate the accumulation of tartar at the gum line. Thus, recession of the gums 40 is substantially eliminated.

ACHIEVEMENTS

The tooth brush 10 according to the invention is a substantial improvement over conventional tooth brushes. The soft bristles of the outer rows 22 massage the gum and remove lodged material. The bristles of the inner rows 20 and central row 16 effect proper tooth scrubbing, without irritating the gums. The nature of the formation of the ends of the inner rows 20 and outer rows 22 effects both proper orientation of the bristles relative to the gums and teeth, and also helps prevent fraying the tips of the bristles of the rows 20 and 22. Thus, not only effective brushing, but also longer life results from the tooth brush of the invention.

Various changes can be made to the invention without departing from the spirit thereof or scope of the following claims.

What is claimed is:

1. In a tooth brush having a longitudinal body, one end of the body forming a handle and the other end of the body having a series of generally parallel longitudinal rows of bristles, the improvement comprising a. a pair of outer rows of bristles, each outer row being located at an opposite side of said rows of bristles, the bristles of said outer rows having a first stiffness, b. a pair of inner rows of bristles, each inner row being located adjacent one of said outer rows, the bristles of said inner rows having a second stiffness greater than said first stiffness, c. a central row of bristles located between said inner rows, the bristles of said central row having a third stiffness not less than said second stiffness, d. the bristles of said central row terminating at and forming a generally flat brushing plane, e. at least a first portion of the bristles of said inner and outer rows on one side of said central row terminating at a first inclined brushing plane and at least a first portion of the bristles of said inner and outer rows on the other side of said central row terminating at a second inclined brushing plane, saidn inclined brushing planes being oriented at an angle of from about 80° to 100° to one another, and f. a second portion of the bristles of said outer rows terminating at a flat surface generally parallel to and spaced from said flat brushing plane.

2. A tooth brush according to claim 1, in which said angle is 90°.

3. A tooth brush according to claim 1, in which said inclined brushing planes are symmetrical with respect to said central row.

4. A tooth brush according to claim 1, in which said flat surface is oriented at an acute angle of from about 40° to 50° to said inclined brushing planes.

5. A tooth brush according to claim 4, in which said acute angle is 45°.

6. A tooth brush according to claim 1, in which said second stiffness is the same as said third stiffness.

7. In a tooth brush having a longitudinal body, one end of the body forming a handle and the other end of the body having a series of generally parallel longitudinal rows of bristles, the improvement comprising a. a pair of outer rows of bristles, each outer row being located at an opposite side of said rows of bristles, the bristles of said outer rows having a first stiffness, b. a pair of inner rows of bristles, each inner row being located adjacent one of said outer rows, the bristles of said inner rows having a second stiffness greater than said first stiffness, c. a central row of bristles located between said inner rows, the bristles of said central row having a third stiffness not less than said second stiffness, d. the bristles of said central row terminating at and forming a generally flat brushing plane, e. at least a first portion of the bristles of said inner and outer rows on one side of said central row terminating at a first inclined brushing plane and at least a first portion of the bristles of said inner and outer rows on the other side of said central row terminating at a second inclined brushing plane, said inclined brushing planes being oriented at an angle of from about 80° to 100° to one another, and f. a second portion of the bristles of said inner rows terminating at a flat surface generally parallel to and spaced from said flat brushing plane.

8. A tooth brush according to claim 7, in which said flat surface is oriented at an acute angle of from about 40° to 50° to said inclined brushing planes.

9. A tooth brush according to claim 8, in which said acute angle is 45°.

10. In a tooth brush having a longitudinal body, one end of the body forming a handle and the other end of the body having a series of generally parallel longitudinal rows of bristles, the improvement comprising a. a pair of outer rows of bristles, each outer row being located at an opposite side of said rows of bristles, the bristles of said outer rows having a first stiffness, b. a pair of inner rows of bristles, each inner row being located adjacent one of said outer rows, the bristles of said inner rows having a second stiffness greater than said first stiffness, c. a central row of bristles located between said inner rows, the bristles of said central row having a third stiffness not less than said second stiffness, d. the bristles of said central row terminating at and forming a generally flat brushing plane, e. at least a first portion of the bristles of said inner and outer rows on one side of said central row terminating at a first inclined brushing plane and at least a first portion of the bristles of said inner and outer rows on the other side of said central row terminating at a second inclined brushing plane, said inclined brushing planes being oriented at an angle of from about 80° to 100° to one another, and f. a second portion of the bristles of said inner rows terminating at a first flat surface generally parallel to and spaced from said flat brushing plane, and a second portion of the bristles of said outer rows terminating at a second flat surface generally parallel to and spaced from said flat brushing plane, said first flat surface being located between said second flat surface and said flat brushing plane.

11. A tooth brush according to claim 10, in which each flat surface is oriented at an acute angle of from about 40° to 50° to said inclined brushing planes.

12. A tooth brush according to claim 10, in which said acute angle is 45°.

* * * * *